US006155962A

United States Patent [19]

Dalrymple et al.

[11] Patent Number: 6,155,962

[45] Date of Patent: Dec. 5, 2000

[54] METHOD OF CONSTRUCTING BEVERAGE BASKET CARRIER

[75] Inventors: Bruce H. Dalrymple, Loganville, Ga.; Tim Pratt, Omaha, Nebr.

[73] Assignee: Malnove of Nebraska, Inc., Omaha, Nebr.

[21] Appl. No.: 09/258,445

[22] Filed: Feb. 26, 1999

Related U.S. Application Data

[62] Division of application No. 08/732,643, Oct. 7, 1996, Pat. No. 5,947,273.

[51] Int. Cl.[7] ..... B31B 11/00

[52] U.S. Cl. ..... 493/90; 493/131

[58] Field of Search ..... 53/48.8; 493/312, 493/90, 92, 91, 912, 131; 206/176, 178

[56] References Cited

U.S. PATENT DOCUMENTS

| | | | |
|---|---|---|---|
| 3,185,047 | 5/1965 | Struble et al. | 493/131 |
| 4,205,748 | 6/1980 | Wilson | 206/174 |
| 4,469,222 | 9/1984 | Graser | 206/180 |
| 4,741,436 | 5/1988 | Davis | 493/90 |
| 4,770,294 | 9/1988 | Graser | 206/180 |
| 4,915,218 | 4/1990 | Crouch et al. | 206/178 |
| 4,986,416 | 1/1991 | Arthurs | 206/170 |
| 5,332,091 | 7/1994 | Gugler | 206/167 |
| 5,680,930 | 10/1997 | Stone | 206/173 |
| 5,876,502 | 3/1999 | Sugimura et al. | 493/131 |

*Primary Examiner*—John Sipos
*Assistant Examiner*—Steven Jensen
*Attorney, Agent, or Firm*—Zarley, McKee, Thomte, Voorhees & Sease; Dennis L. Thomte

[57] ABSTRACT

The beverage basket carrier of the invention is constructed of two separate blanks, a primary blank including the printed surfaces of the carrier and a secondary blank including the internal divider walls forming the bottle receiving cells. The blanks are designed so as to be tipped together in a straight line gluer for substantially increased production rates. The secondary blank may be formed of a different and more economical substrate than that required for the primary blank. The reduced size primary blanks enable an increased number to be arranged across a sheet or printing cylinder to increase the yield of the printing process. The resulting assembled carrier is similar to conventional carriers and suited for use by bottle fillers without altering their equipment.

6 Claims, 6 Drawing Sheets

METHOD OF CONSTRUCTING BEVERAGE BASKET CARRIER

CROSS-REFERENCE TO RELATED APPLICATION

This is a divisional application of Petitioners' earlier application Ser. No. 08/732,643 filed Oct. 7, 1996, now U.S. Pat. No. 5,947,273 entitled BEVERAGE BASKET CARRIER.

BACKGROUND OF THE INVENTION

1. Technical Field

This invention is directed generally to beverage basket carriers of the type used primarily for holding beverage bottles of beer, sodas, wine coolers ar other nonbeverage specialty goods. The invention is more particularly directed to such a beverage basket carrier formed from two separate blanks including a primary blank including the exterior printed surfaces of the carrier and a secondary blank including a portion of the central divider wall and all of the cell walls extended between the divider wall and the front and back walls. The invention is further directed to the method of fabricating such carrier wherein the secondary blank is tipped into the primary blank in a straight line gluing unit for increased production rates.

2. Description of the Prior Art

Beverage basket carriers are well known as containers for bottled beer, wine coolers and soda. Such carriers were more commonplace in the era when beverages were sold in returnable bottles. The carriers were printed, cut and folded, then shipped to either bottlers or glass manufacturers or various converter suppliers. The fabrication of such carriers was extremely slow compared to other carton manufacturing due to the inherent complex gluing requirements.

Basket carriers are folded and bonded using a right-angle gluing unit. When this gluing unit is also used to run other business requiring changeover, speed will vary but in general a maximum production rate of five thousand or six thousand carriers per hour is typical. If a right-angle gluer is dedicated and welded into place to only run basket carrier packaging, some converters can run this package as high as approximately twelve thousand carriers per hour but the gluer is then rendered inoperative for anything other than the basket carriers.

Graser U.S. Pat. No. 4,469,222 and Graser U.S. Pat. No. 4,770.294 both disclose a two-piece beverage carrier wherein an insert comprises the handle, longitudinal divider wall and transverse divider walls adapted to be connected by tabs and adhesive within either a wrap-around shell or a basket style shell. In the noncollapsible basket style shell illustrated in FIG. 1 thereof, printed surfaces are included on both the insert and the outer shell, thereby requiring that both pieces be run through a printer. In the wrap-around carrier of FIG. 9 thereof, it appears that the printed surfaces could be restricted to the shell but since the overall basket carrier is not collapsible, bottle fillers would have to alter their filling equipment to accommodate this carrier.

Wilson 4,205,748 shows a basket carrier with a separate blank provided for the transverse divider walls on only one half of the basket carrier. The blank could be arranged only four across on conventional flat stock material and right angle processing would be required to make the folds.

Accordingly, a primary object of the invention is to provide an improved beverage basket carrier and method of constructing it, which carrier is capable of assembly at substantially increased production rates and al reduced material costs.

Another object of the invention is to provide a beverage basket carrier and method of constructing it wherein the carrier is adapted to be formed on a straight line gluing unit with the greatly increased production rates over those possible with a right-angle gluing unit.

Another object of the invention is to provide a beverage basket carrier and method of constructing it wherein two separate blanks are used, one including all printed surfaces and being of a reduced size compared to conventional one piece blanks so that it can be arranged six across on standard sheet stock for an approximate fifty percent increase in production even before considering increasing the production speed.

Another object of the invention is to provide a beverage basket carrier and method of constructing it which enables a secondary blank of internal nonprinted walls to be a uniform insert for carriers having different print on the exterior thereof and optionally of a lower grade more economical material than that of the primary blank.

Another object of the invention is lo provide a beverage basket carrier and method of constructing it which is operative to turn out carriers of similar specifications to conventional carriers so that bottle fillers need not alter their equipment to accommodate the carriers of the invention.

Another object of the invention is to provide an improved beverage basket carrier which is simple and rugged in construction, economical to manufacture and efficient in operation.

SUMMARY OF THE INVENTION

The improved beverage basket carrier of the invention is constructed from a primary blank and a separate secondary blank. The smaller secondary blank includes those surfaces which are not typically printed, namely at least a portion of the divider wall and all of the transverse cell walls. The primary blank includes all of the remaining walls including those which are typically printed for advertising the beverage or goods for which the carrier is designed.

Because the primary blank is approximately thirty percent smaller than conventional one piece blanks, at least two and sometimes possibly more print positions are available on a sheet or printing cylinder as the carrier advances through the press. This affords a huge advantage in terms of yield in the printing process. The secondary blank which serves as the divider and cell walls separating the bottles can 15 now be made of a different substrate, such as one which does not require a clay coating for printing purposes and which is therefore more economical than the substrate used for the primary blank.

In the method of constructing the improved beverage basket carrier of the invention, the primary blank is fed into a straight line gluer where a pattern of adhesives is applied to it. The secondary blank is "tipped into" the primary blank and bonded to it. Because this is a straight line operation, production rates of 20,000 to 25,000 per hour are expected.

DESCRIPTION OF THE PREFERRED EMBODIMENT

Figure 1:
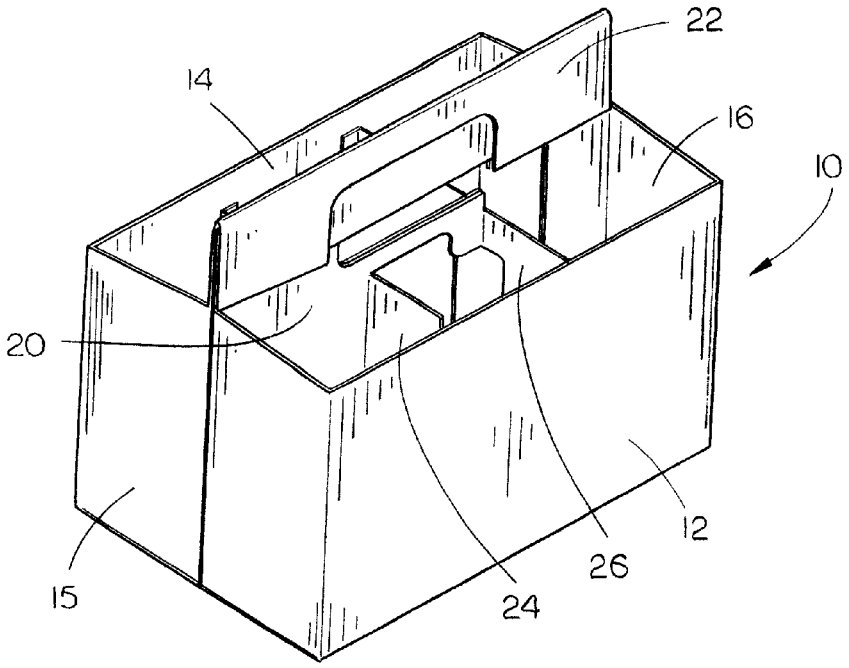
FIG. 1 is a perspective view of the fully assembled carrier of the invention.

The beverage basket carrier 10 of the invention is illustrated in FIG. 1 as resembling a conventional beverage basket carrier and including a front wall 12, and back wall 14, opposite side walls 15 and 16, and a bottom wall 18 extend between and connected to the front wall 12, back wall 14. A divider wall 20 is arranged generally parallel to the front wall 12 and back wall 14 and is generally centered be A handle 22 extends between the opposite end walls above the divider wall. Finally, transverse cell walls 24 and 26 extend from the divider wall 20 to the front and back walls 12 and 14 to divide the spaces between those walls into individual open topped article receiving cells.

Figure 2:
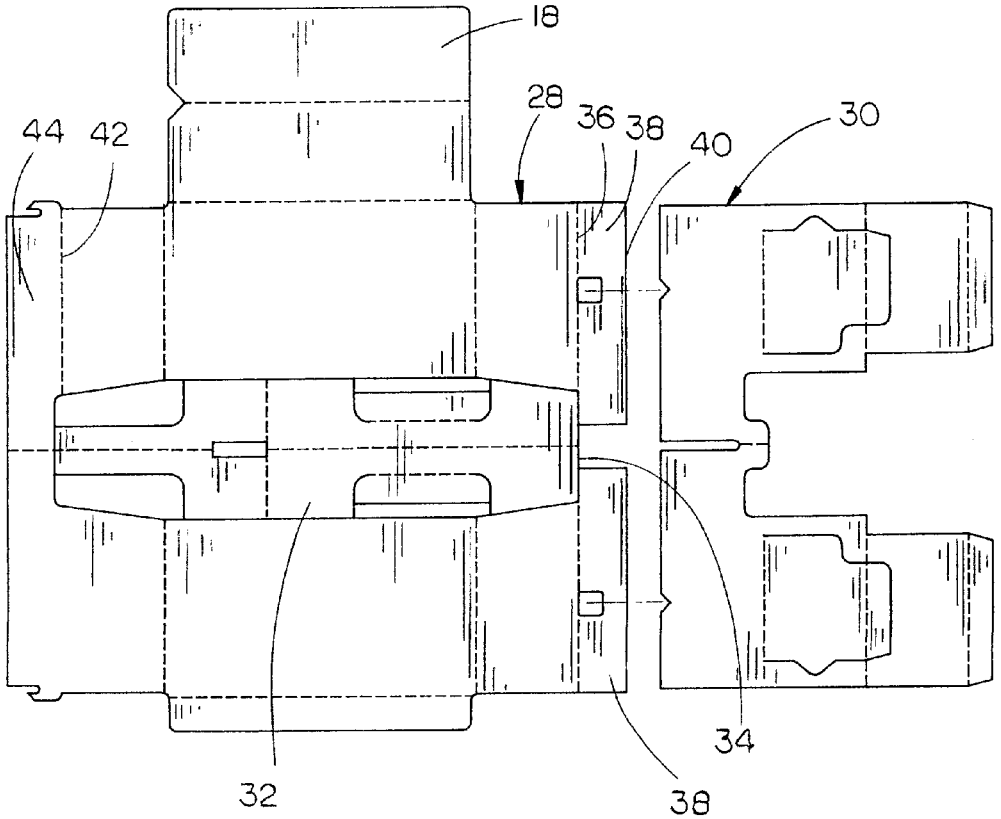
FIG. 2 is a plan view of the two blanks for the carrier, specific noncompliance embodiment.

The basket carrier of the invention is constructed from two separate blank, a larger primary blank 28 and a smaller secondary blank 30, as shown in FIG. 2.

The primary blank 28 is cut from flat stock material in a shape including a central handle portion 32 having a free end 34. The front and back walls 12 and 14 are arranged on opposite sides of said central handle portion 32. The bottom wall 18 protrudes from an opposite edge 36 of one of said front and back walls 12 and 14. One end wall 15 is connected to one end of said front and back walls and includes an end flap 38 on the free end 40 thereof. The opposite end wall 16 is connected to the opposite end 42 of front and back walls 12 and 14 and includes an opposite end wall flap 44 on the free end 47 thereof.

The secondary blank is cut from flat stock material in a generally U-shaped including a base wall strip 46 and two divider wall panels 48 and 50 extended outwardly therefrom. Each divider wall panel includes at least one cell wall 24 or 26 hingedly connected to it.

Figure 3:
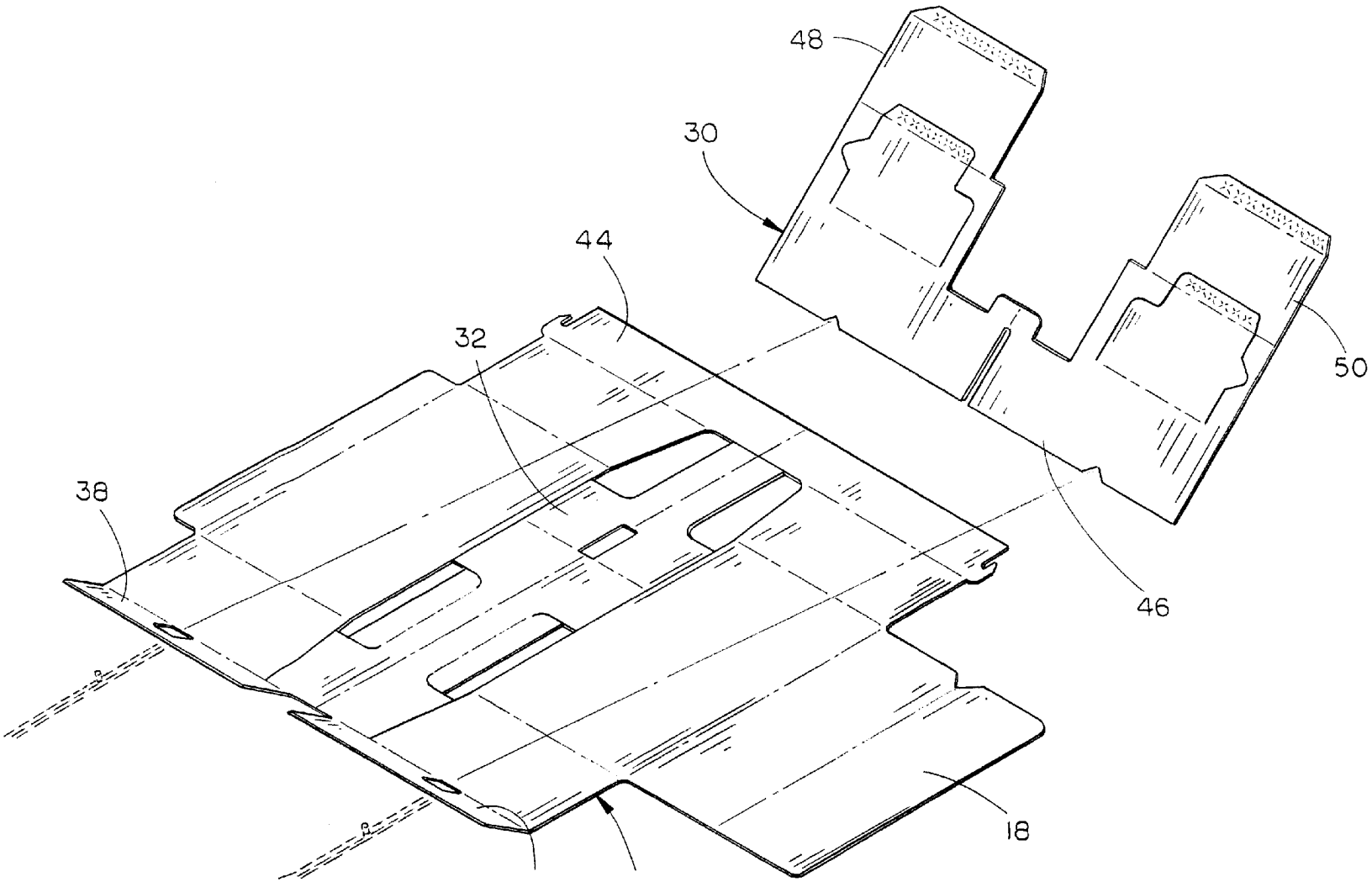
FIG. 3 is a perspective view showing the process of tipping the secondary blank into the primary blank.
Figure 4:
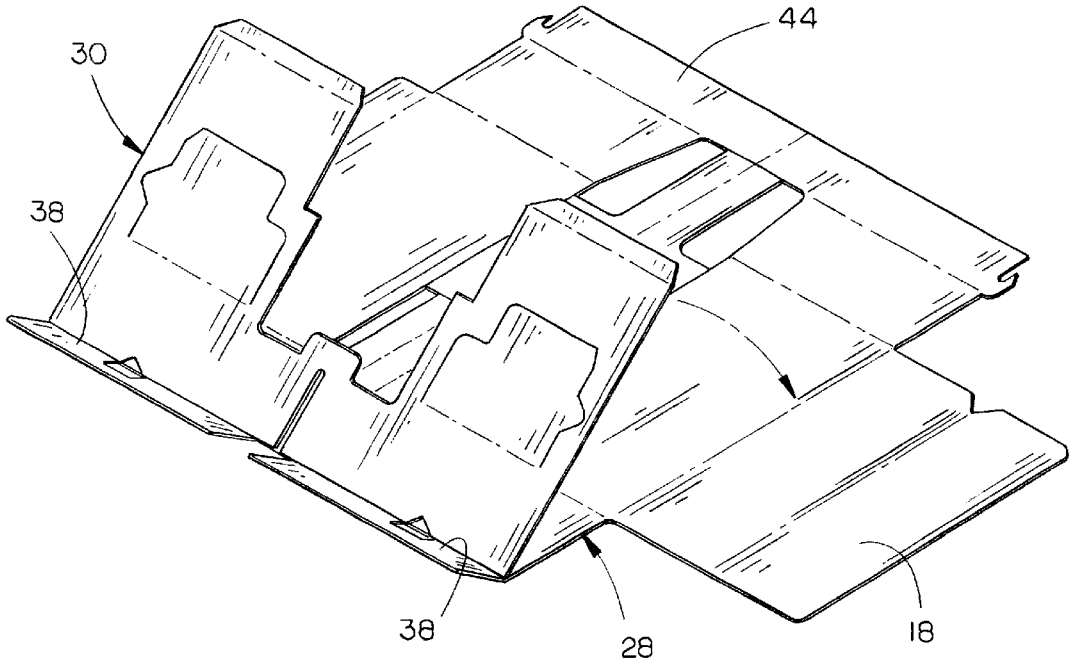
FIG. 4 shows the merged position of the two blanks.
Figure 5:
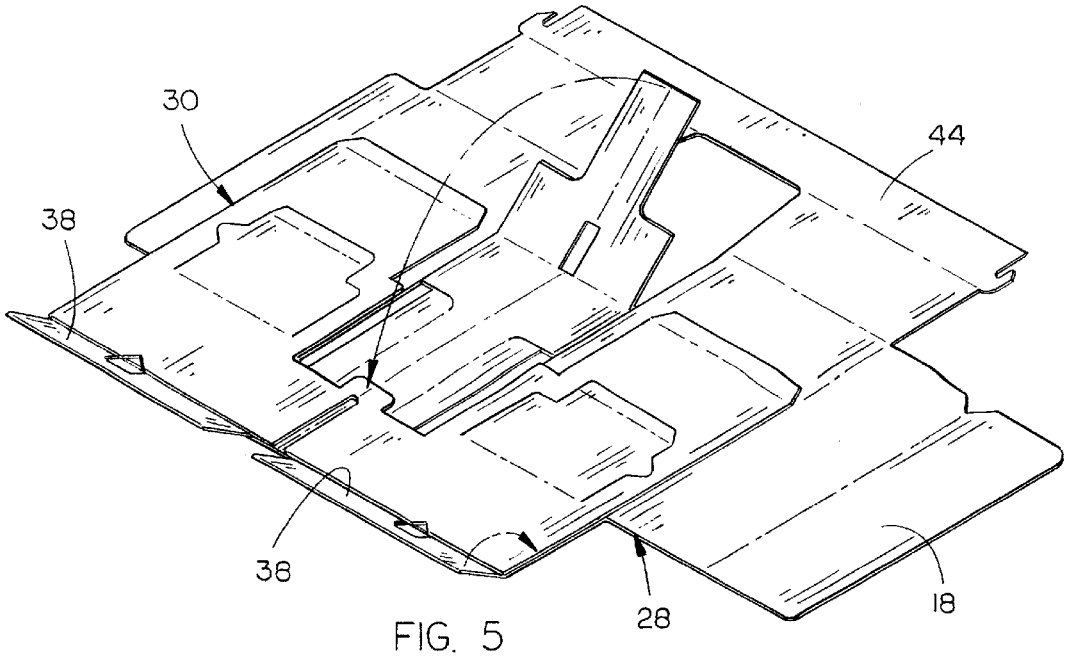
FIG. 5 shows the handle portion being folded.

FIGS. 3–5 show that the secondary blank 30 is tipped into said primary blank 28 to join said base wall strip 46 to the end wall flap 38. The central handle portion 32 is then folded in half and has the free end thereof glued to the tipped in secondary blank.

Figure 6:
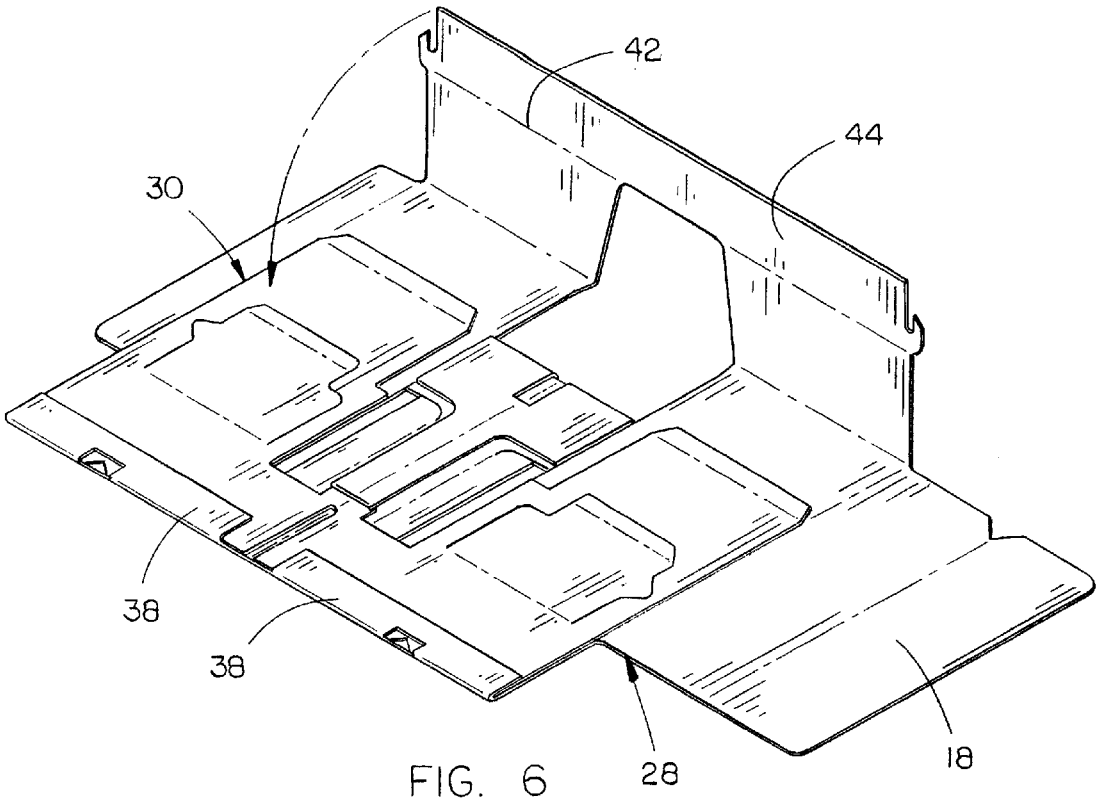
FIG. 6 shows one end of the primary blank being folded onto the handle portion.
Figure 7:
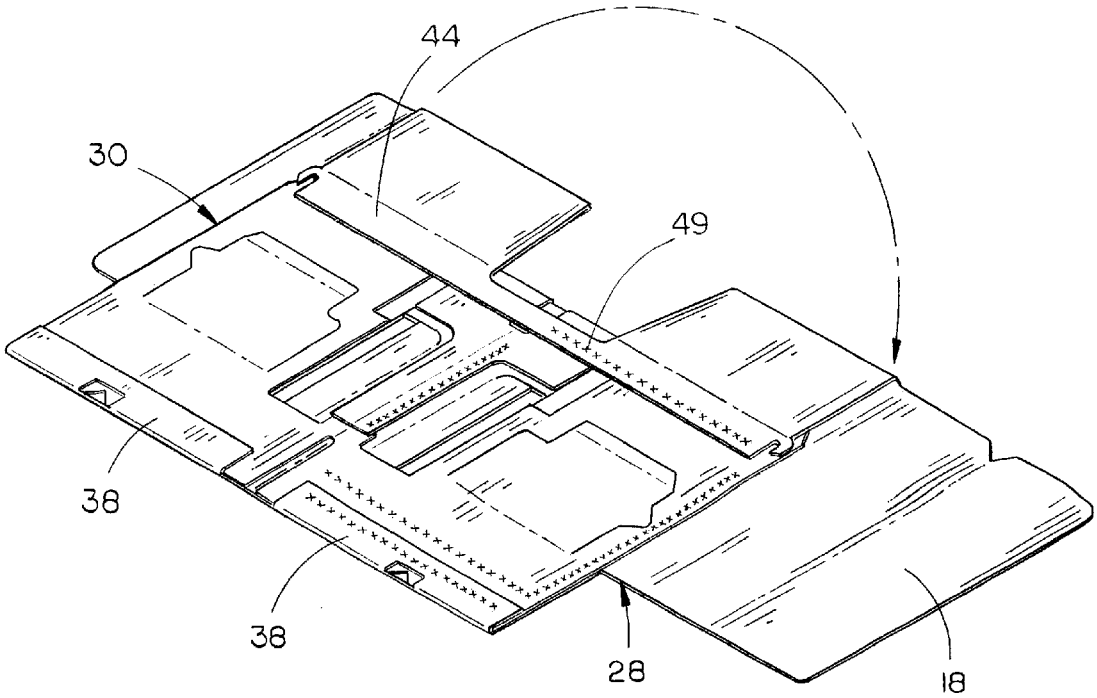
FIG. 7 shows the application of glue prior to folding the merged blank in half.
Figure 8:
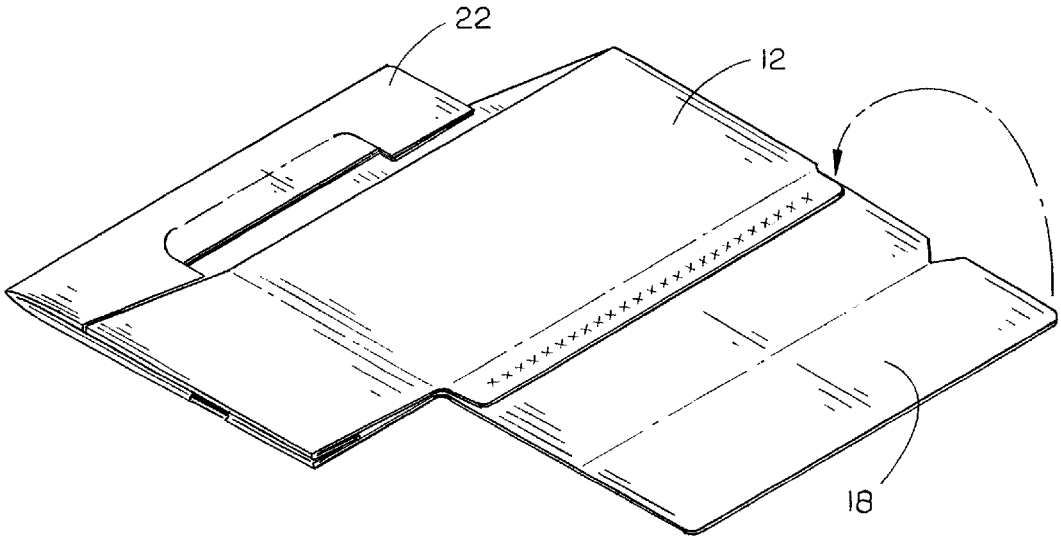
FIG. 8 shows the folding and gluing of the bottom wall of the carrier.
Figure 9:
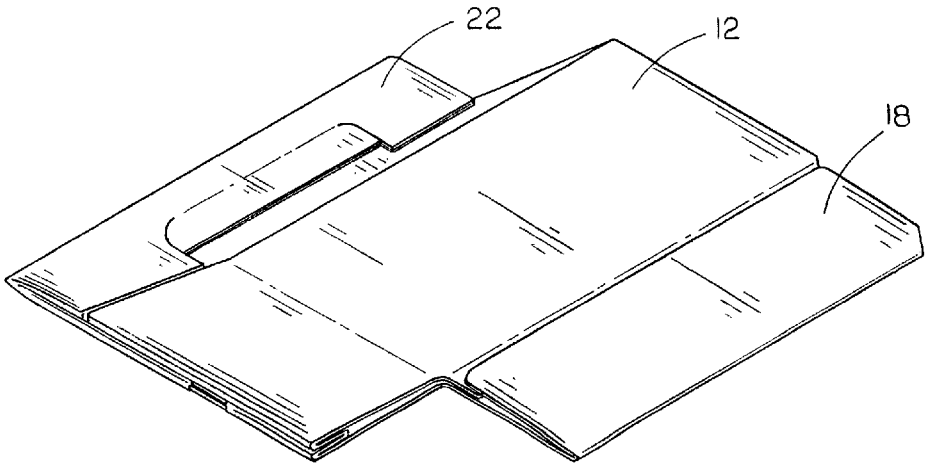
FIG. 9 shows the fully assembled carrier in a flattened form for storage and shipment.

Assembly proceeds with folding and gluing the end wall flap onto the tipped in secondary blank. The next step involves folding said opposite end wall 16 toward and over the secondary blank 30, as shown in FIG. 6.

Next, a perimeter of glue 49 is applied around one half of the partially assembled carrier including glue on said end wall flap 38 and on said opposite end wall flap 44, along said handle portion and along opposite edges of said secondary blank.

The partially assembled carrier is then folded in half to adhere the end wall flap to itself and said opposite end wall flap 44 to itself. The bottom wall is folded to contact the other of said front wall and back wall.

Finally, the bottom wall is glued to the other of said front wall and back wall, thereby completing assembly of said carrier in a flat collapsed position.

Figure 10:
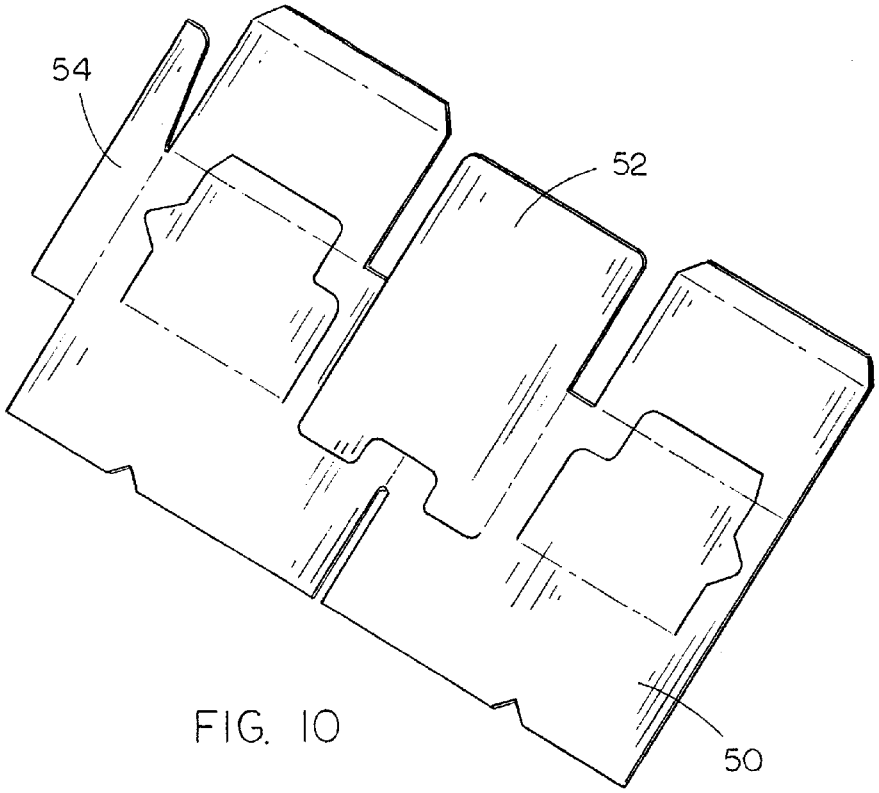
FIG. 10 shows an alternate full compliance secondary blank.
Figure 11:
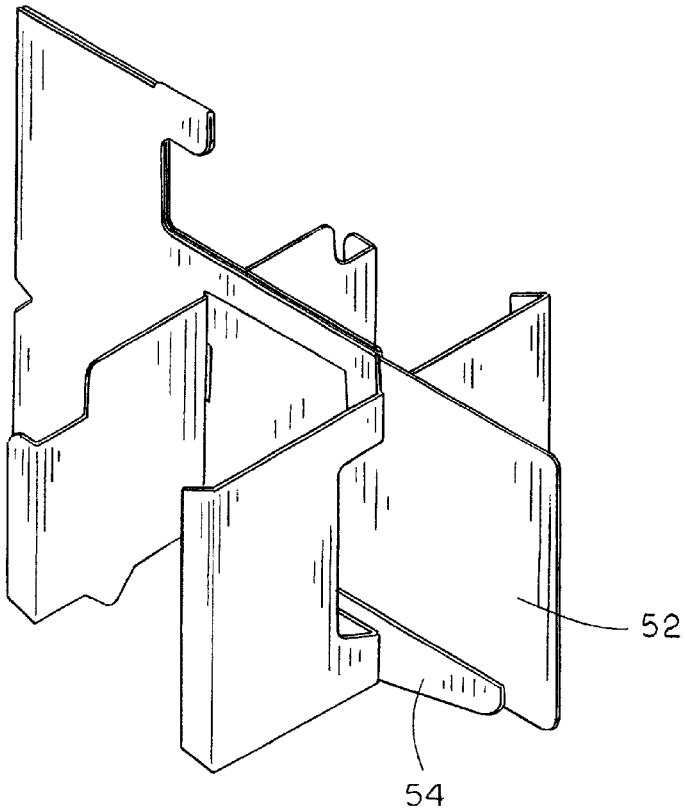
FIG. 11 shows the folded open full compliance secondary blank of FIG. 10.

FIGS. 10 and 11 illustrate an alternate secondary blank 50 including an extra divider panel 52 and connecting strip 54 which take the positions illustrated in FIG. 11 in their installed positions.

We claim:

1. A method of constructing a completely erected collapsible beverage basket carrier that is ready for use having a front wall, a back wall, opposite side walls, a bottom wall extended between and connected to said front wall, back wall and side walls, a divider wall generally parallel to said front wall and back wall and disposed therebetween, a handle extended between said opposite side walls above said divider wall, and cell walls extended transversely from said divider wall to connections to said front and back walls respectively to divide the spaces between said divider wall and front and back walls respectively into individual open topped article receiving cells, said method comprising, providing a providing a primary blank and a separate secondary blank, said secondary blank comprising at least a portion of said divider wall and all of said cell walls, said primary blank comprising the remainder of said walls, advancing said primary blank through a straight line glue unit, tipping said secondary blank into said primary blank, bonding said secondary blank to said primary blank, folding and further bonding said primary and secondary blanks together in said straight line gluing unit to completely form said erected collapsible beverage basket carrier, wherein said secondary blank is glued to said primary blank adjacent one side wall and at the respective connections of each cell wall to said front wall and back wall.

2. The method of claim 1 wherein providing said primary and secondary blanks comprises cutting said primary and secondary blanks from generally flat stock material.

3. The method of claim 2 wherein said cutting step comprises providing types of flat stock material of different substrates and cutting said primary and secondary blanks from different respective stock material.

4. The method of claim 3 wherein the flat stock material of said primary blank has at least one surface adapted for receiving and displaying offset printing thereon.

5. The method of claim 4 wherein the flat stock material of said secondary blank is of a lower grade than the different flat stock material of said primary blank.

6. The method of claim 4 wherein said primary blanks are arranged so that six primary blanks are formed from said flat stock material, said flat stock material being of standard size.

* * * * *